US012799400B2

(12) United States Patent
Holcombe et al.

(10) Patent No.: US 12,799,400 B2
(45) Date of Patent: Nov. 17, 2026

(54) PROCESS FOR PRODUCING MESOPHASE PITCH

(71) Applicant: ACP Technologies, LLC, St. Clair Shores, MI (US)

(72) Inventors: Thomas Charles Holcombe, Hillsborough, NJ (US); Ying Liu, Houston, TX (US); David Christian Boyer, Palm Coast, FL (US); Lane Gerald Malone, Grayson, KY (US); Mohammed I. L. Abutaqiya, League City, TX (US); Dominic Lucchi, Royal Oak, MI (US)

(73) Assignee: ACP Technologies, LLC, St. Clair Shores, MI (US)

( * ) Notice: Subject to any disclaimer, the term of this patent is extended or adjusted under 35 U.S.C. 154(b) by 212 days.

(21) Appl. No.: 18/742,343

(22) Filed: Jun. 13, 2024

(65) Prior Publication Data

US 2025/0382526 A1 Dec. 18, 2025

(51) Int. Cl.
*C10C 3/00* (2006.01)
*C10C 3/02* (2006.01)

(52) U.S. Cl.
CPC ..... *C10C 3/026* (2013.01)

(58) Field of Classification Search
CPC ..... C10C 3/002; C10C 3/026
See application file for complete search history.

(56) References Cited

U.S. PATENT DOCUMENTS

| | | | |
|---|---|---|---|
| 3,974,264 | A | 8/1976 | McHenry |
| 4,017,327 | A | 4/1977 | Lewis et al. |
| 4,026,788 | A | 5/1977 | McHenry |
| 4,039,423 | A | 8/1977 | Moyle et al. |
| 4,209,500 | A | 6/1980 | Chwastiak |
| 4,243,512 | A | 1/1981 | Seo |
| 4,317,809 | A | 3/1982 | Lewis et al. |
| 4,487,685 | A | 12/1984 | Watanabe |
| 4,488,957 | A | 12/1984 | Noguchi et al. |
| 4,529,498 | A | 7/1985 | Watanabe |
| 4,533,461 | A | 8/1985 | Izumi et al. |
| 4,551,225 | A | 11/1985 | Dickakian |

(Continued)

FOREIGN PATENT DOCUMENTS

WO 02/40754 A1 5/2002

*Primary Examiner* — Prem C Singh
*Assistant Examiner* — Brandi M Doyle
(74) *Attorney, Agent, or Firm* — David Guerra

(57) ABSTRACT

A process for producing mesophase pitch includes charging a mixture of a carrier gas and a hydrocarbon feed including isotropic pitch to a reactor operating at thermal operating conditions sufficient to induce conversion of at least one chosen from the hydrocarbon feed and the isotropic pitch to mesophase pitch such that the mixture of the hydrocarbon feed and the carrier gas establishes a stratified flow regime having a vapor phase and a liquid phase in the reactor. The process also includes maintaining thermal operating conditions in the reactor while the mixture of the hydrocarbon feed and the carrier gas is flowing in the stratified flow regime in the reactor such that conversion of the at least one chosen from the hydrocarbon feed and the isotropic pitch to mesophase pitch is induced in the liquid phase. The process further includes discharging an effluent including mesophase pitch from the reactor.

20 Claims, 6 Drawing Sheets

(56) References Cited

U.S. PATENT DOCUMENTS

| | | | | |
|---|---|---|---|---|
| 4,554,118 | A | 11/1985 | Seifert | |
| 4,589,974 | A | 5/1986 | Izumi | |
| 4,591,424 | A | 5/1986 | Gomi et al. | |
| 4,601,813 | A | 7/1986 | Izumi et al. | |
| 4,608,150 | A | 8/1986 | Itoi et al. | |
| 4,818,612 | A | 4/1989 | Hara et al. | |
| 4,892,641 | A | 1/1990 | Fu et al. | |
| 4,892,642 | A | 1/1990 | Romine et al. | |
| 4,904,371 | A | 2/1990 | Kalback | |
| 4,976,845 | A | 12/1990 | Oerlemans et al. | |
| 5,032,250 | A | 7/1991 | Romine et al. | |
| 5,198,101 | A | 3/1993 | Kalback | |
| 5,403,660 | A | 4/1995 | Takabatake et al. | |
| 9,222,027 | B1 | 12/2015 | Malone et al. | |
| 10,508,240 | B2 | 12/2019 | Mahfouz et al. | |
| 10,913,901 | B2 | 2/2021 | Mahfouz et al. | |
| 11,248,172 | B2 | 2/2022 | Malmqvist et al. | |
| 11,319,490 | B2 | 5/2022 | Mahfouz et al. | |
| 11,319,491 | B1 * | 5/2022 | Holcombe | B01J 19/06 |
| 11,624,029 | B2 | 4/2023 | Malmqvist et al. | |

* cited by examiner

PROCESS FOR PRODUCING MESOPHASE PITCH

BACKGROUND OF THE INVENTION

1. Field of the Invention

The invention generally relates to a process for producing mesophase pitch.

2. Description of the Related Art

Some hydrocarbon feedstocks, such as oils, commonly contain heavy fractions known as pitch. Pitch has a high carbon content and is useful for binding other carbon-containing materials together. One subset of pitch is commonly referred to as isotropic pitch. Isotropic pitch has the same physical properties regardless of the direction of measurement. Another subset of pitch is commonly referred to as mesophase pitch. Mesophase pitch is a liquid with crystal properties, and is anisotropic; that is, mesophase pitch has different physical properties when measured in different directions. Mesophase pitch is understood to have properties which make it useful for certain applications for which isotropic pitch is not useful.

To convert isotropic pitch to mesophase pitch, the isotropic pitch is commonly converted to a vapor and subjected to elevated temperatures. However, these elevated temperatures have also tended to produce coke. Coke is an undesirable and largely commercially worthless impurity which not only contaminates not only the mesophase pitch produced, but which also contaminates the processing equipment (e.g., a reactor). Coke which contaminates the processing equipment, such as a reactor, needs to be periodically removed, thus necessitating shutting down to remove the coke and consuming valuable reactor time. Moreover, these elevated temperatures also tend to leech metal from the processing equipment (e.g., the reactor), which is another impurity in the mesophase pitch.

As such, there remains a need for an improved process to create mesophase pitch.

SUMMARY OF THE INVENTION AND ADVANTAGES

A process for producing mesophase pitch includes the step of charging a mixture of a carrier gas and a hydrocarbon feed including isotropic pitch to a reactor operating at thermal operating conditions sufficient to induce conversion of at least one chosen from the hydrocarbon feed and the isotropic pitch to mesophase pitch such that the mixture of the hydrocarbon feed and the carrier gas establishes a stratified flow regime in the reactor. The stratified flow regime has a vapor phase and a liquid phase. The process also includes the step of maintaining thermal operating conditions in the reactor while the mixture of the hydrocarbon feed and the carrier gas is flowing in the stratified flow regime in the reactor such that conversion of the at least one chosen from the hydrocarbon feed and the isotropic pitch to mesophase pitch is induced in the liquid phase. The process further includes the step of discharging an effluent from the reactor, with the effluent including the mesophase pitch.

Accordingly, establishment of the stratified flow regime in the reactor permits conversion of the at least one chosen from the hydrocarbon feed and the isotropic pitch to mesophase pitch in the liquid phase of the stratified flow regime. In other words, the conversion to mesophase pitch occurs in the liquid phase of the stratified flow regime. Conversion of the at least one chosen from the hydrocarbon feed and the isotropic pitch to mesophase pitch in the liquid phase of the stratified flow regime permits the process to be continuous and thus capable of producing the mesophase pitch in a commercially viable, low-cost manner. When the velocity of the vapor phase in a stratified flow regime in a horizontal pipe is higher than the velocity of the liquid phase, the vapor phase will cause the velocity of the liquid phase to increase. Thus, a key advantage of producing mesophase pitch in a reactor using a stratified flow regime is that the velocity and residence time of the liquid phase can be controlled by adjusting the carrier gas feed rate to the reactor, thereby enabling control of the composition of the mesophase pitch product to a high degree.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
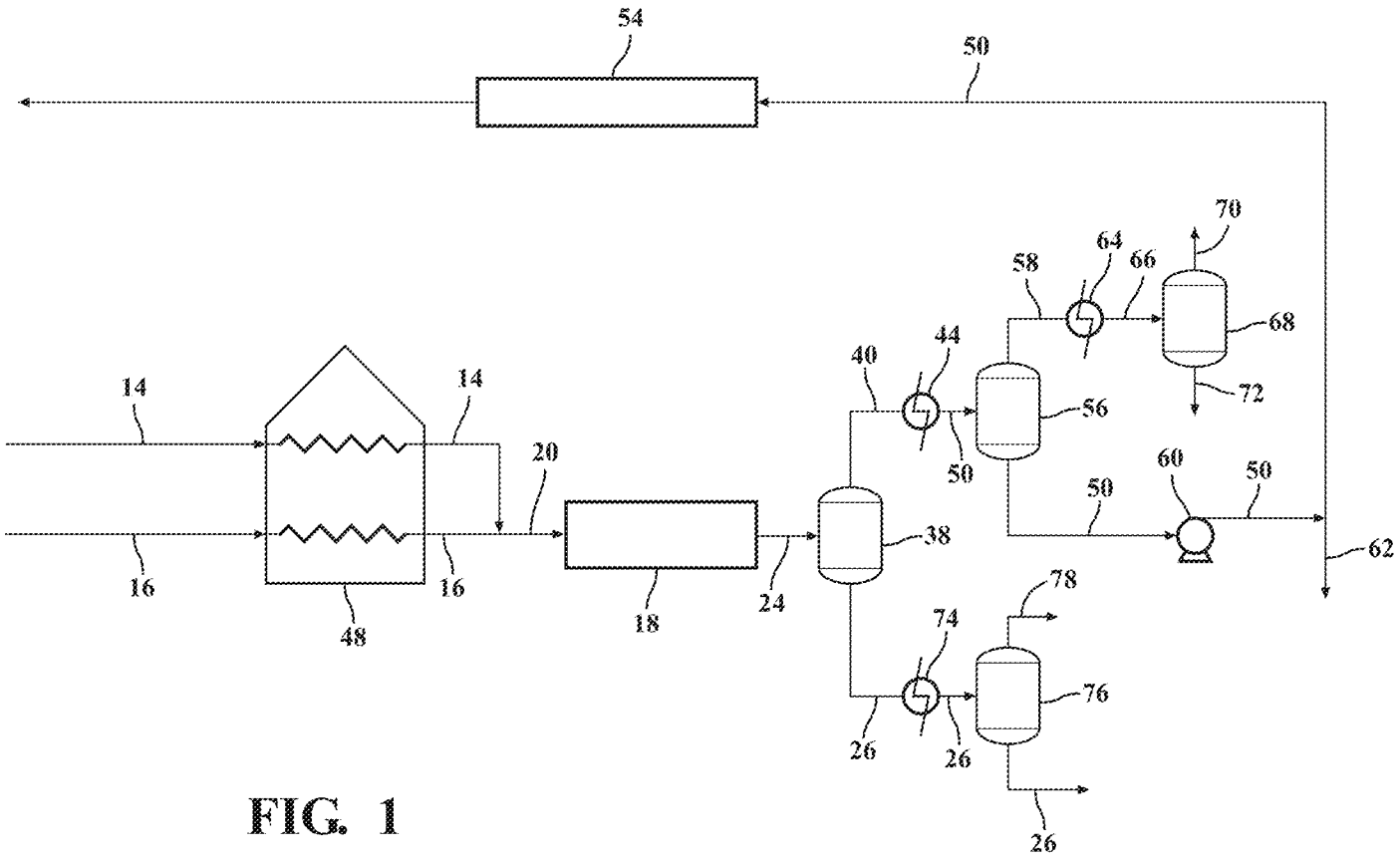
FIG. 1 is a schematic illustration of a system to conduct a process including charging a carrier gas and a hydrocarbon feed having isotropic pitch to a reactor such that a stratified flow regime is established in the reactor, and discharging an effluent having mesophase pitch from the reactor.

With reference to the Figures, wherein like numerals indicate like parts throughout the several views, a process 10 for producing mesophase pitch is provided. The process 10 includes the step 12 of charging a mixture 20 of a carrier gas 14 and a hydrocarbon feed 16 including isotropic pitch to a reactor 18 operating at thermal operating conditions sufficient to induce conversion of at least one chosen from the hydrocarbon feed 16 and the isotropic pitch to mesophase pitch such that the mixture 20 of the hydrocarbon feed 16 and the carrier gas 14 establishes a stratified flow regime in the reactor 18. The stratified flow regime has a vapor phase and a liquid phase. The process 10 also includes the step of maintaining thermal operating conditions in the reactor 18 while the mixture 20 of the hydrocarbon feed 16 and the carrier gas 14 is flowing in the stratified flow regime in the reactor 18 such that conversion of the at least one chosen from the hydrocarbon feed and the isotropic pitch to mesophase pitch is induced in the liquid phase. The process 10 further includes the step 22 of discharging an effluent 24 from the reactor 18, with the effluent 24 including the mesophase pitch.

Accordingly, establishment of the stratified flow regime in the reactor 18 permits conversion of the at least one chosen from the hydrocarbon feed 16 and the isotropic pitch to mesophase pitch in the liquid phase of the stratified flow regime. In other words, the conversion to mesophase pitch occurs in the liquid phase of the stratified flow regime. Conversion of the at least one chosen from the hydrocarbon feed 16 and the isotropic pitch to mesophase pitch in the liquid phase of the stratified flow regime permits the process 10 to be continuous and thus capable of producing the mesophase pitch in a commercially viable, low-cost manner.

The step 12 of charging the mixture of the hydrocarbon feed 16 and the carrier gas 14 such that the mixture of the hydrocarbon feed 16 and the carrier gas 14 establishes a stratified flow regime in the reactor 18, with the stratified flow regime having the vapor phase and the liquid phase, permits the vapor phase to physically move the liquid phase through the reactor 18. As such, the process 10 may include the step of controlling a flow rate of the liquid phase through controlling the flow rate of the carrier gas 14. Increasing the flow rate of the carrier gas 14, therefore, can be used to deliberately increase the flow rate of the liquid phase in the reactor 18.

The carrier gas 14 may include any non-oxidizing, inert gas. The carrier gas 14 may include, but is not limited to, steam including superheated steam, nitrogen, oxygen, argon, vaporized hydrocarbons including light distillates such as alkanes and distillate boiling range materials, and combinations thereof. The hydrocarbon feed 16 may be from a variety of sources given that it includes isotropic pitch. Further discussion of sources of the hydrocarbon feed 16 is detailed below.

The hydrocarbon feed 16 may be provided from a holding tank or the like. However, in some embodiments, the hydrocarbon feed 16 may be provided from a polymerization reactor. More specifically, the hydrocarbon feed 16 including the isotropic pitch may be provided by a step of charging a feed including a distillate boiling range aromatic rich liquid to an inlet of a polymerization reactor, a step of converting the feed including the distillate boiling range aromatic rich liquid within the polymerization reactor at a temperature sufficiently high to induce thermal polymerization of the feed, at a pressure sufficient to maintain at least a majority by weight of the feed in a liquid phase, and for a time sufficient to convert at least a portion of the feed to isotropic pitch and boiling range material, and a step of discharging from the polymerization reactor an effluent stream including the isotropic pitch and the boiling range material. The effluent stream, in short, may be used to provide the hydrocarbon feed 16 in the process 10. The distillate boiling range aromatic rich liquid fed into the polymerization reactor 18 may include, but is not limited to, slurry oil including filtered slurry oil and clarified slurry oil (e.g., from a catalytic cracking unit), main column bottoms, ethylene crackers including ethylene cracker intermediates and ethylene cracker bottoms, feedstocks such as oils, distillates, fractions, intermediates, bottoms, or solvated fractions of petroleum, coal, shale, steam crackers, cokers (either, or both, petroleum and coal), bio-oils, SATC (solvent extracted oils or fractions from petroleum and petroleum processes, coal, shale, and/or bio-oils), coal tar pitch, petroleum pitch, and other multi-ring aromatic compounds such as naphthalene.

Moreover, the polymerization reactor may operate at thermal polymerization conditions and for a time sufficient to convert at least 20 weight percent of the feed to the isotropic pitch. Such isotropic pitch may be provided using the process and polymerization reactor operating at thermal polymerization conditions detailed in U.S. Pat. No. 9,222,027 B2, filed Mar. 11, 2013 and entitled "Single Stage Pitch Process and Product", the contents of which are hereby incorporated by reference in their entirety.

The polymerization reactor increases the molecular weight of the distillate boiling range aromatic rich liquid. Any small molecules which may interfere with conversion of the hydrocarbon feed 16 and/or the isotropic pitch to mesophase pitch should be removed. As such, the process 10 may also include the step of removing low molecular weight molecules from the hydrocarbon feed 16, such as by distillation, wiped film evaporation, or by steam stripping, as non-limiting examples.

The hydrocarbon feed 16, whether provided from a holding tank, provided from the polymerization reactor, or otherwise, may have at least 1 percent isotropic pitch, may have at least 5 percent isotropic pitch, may have at least 10 percent isotropic pitch, may have at least 20 percent isotropic pitch, may have at least 30 percent isotropic pitch, may have at least 40 percent isotropic pitch, may have at least 50 percent isotropic pitch, may have at least 60 percent isotropic pitch, may have at least 70 percent isotropic pitch, may have at least 80 percent isotropic pitch, or may even have at least 90 percent isotropic pitch. It is to be appreciated that the hydrocarbon feed 16 used in the process 10 may even consist essentially completely of isotropic pitch.

It is to be appreciated that the hydrocarbon feed 16 may contain a measure of mesophase pitch prior to conversion through the process 10. The hydrocarbon feed 16 may contain less than about 20 percent mesophase pitch by volume, may contain less than about 15 percent mesophase pitch by volume, may contain less than about 10 percent mesophase pitch by volume, may contain less than about 9 percent mesophase pitch by volume, may contain less than about 8 percent mesophase pitch by volume, may contain less than about 7 percent mesophase pitch by volume, may contain less than about 6 percent mesophase pitch by volume, may contain less than about 5 percent mesophase pitch by volume, may contain less than about 4 percent mesophase pitch by volume, may contain less than about 3 percent mesophase pitch by volume, may contain less than about 2 percent mesophase pitch by volume, or may even contain less than about 1 percent mesophase pitch by volume. In light that the hydrocarbon feed 16 may contain less than about 20 percent mesophase pitch by volume, it is to further be appreciated that the process 10 is able be used as the primary conversion of the hydrocarbon feed 16 (e.g., the isotropic pitch in the hydrocarbon feed 16) to mesophase pitch. Additionally, the components of the hydrocarbon feed 16 other than the isotropic pitch which are able to be converted by the process 10 to mesophase pitch are aromatic. As non-limiting examples, the components may be include two, three, or more than three aromatic rings.

Conditions of the hydrocarbon feed 16 fed to the reactor 18, as well as conditions within the reactor 18 such as reactor temperature and reactor pressure, may be varied in the process 10 dependent upon the particular composition of the hydrocarbon feed 16. Conditions of the hydrocarbon feed 16 fed to reactor 18, as well as conditions within the reactor 18 such as reactor temperature and reactor pressure, may also be varied in the process 10 dependent upon the particular scale at which the process 10 is operated.

Although not required, the vapor phase may flow at an average superficial velocity of less than about 120 feet per second. It is also contemplated that the vapor phase may also flow at an average superficial velocity of less than about 110 feet per second, less than about 100 feet per second, less than about 90 feet per second, less than about 80 feet per second, less than about 70 feet per second, less than about 60 feet per second, less than about 50 feet per second, less than about 40 feet per second, less than about 30 feet per second, less than about 20 feet per second, or even less than about 10 feet per second. It is to be appreciated that the average superficial velocity of the vapor phase may be dependent in part upon the particular scale at which the process 10 is operated. As a non-limiting example, the reactor 18 may be cylindrical, such as a tube or a pipe, and the reactor 18 may have an inner diameter. In embodiments where the inner diameter of the reactor 18 is between about 3 inches and about 6 inches, the superficial velocity of the vapor phase may be between about 100 feet per second and about 120 feet per second, resulting in the mixture 20 of the hydrocarbon feed 16 and the carrier gas 14 establishing the stratified flow regime in the reactor 18. However, in embodiments where the inner diameter of the reactor is decreased (e.g., is smaller than 3 inches), the superficial velocity of the vapor phase should likewise be decreased. As a non-limiting example, the inner diameter of the reactor 18 may be about ¾th of an inch, and the superficial velocity of the vapor phase may be less than about 50 feet per second, resulting in the mixture of the hydrocarbon feed 16 and the carrier gas 14 establishing the stratified flow regime in the reactor 18.

The superficial velocity of the vapor phase may be calculated by dividing the volumetric flow rate of the vapor phase by the cross-sectional area of the reactor 18. The superficial velocity of the vapor phase is a hypothetical flow velocity calculated as if the vapor phase were the only fluid phase present in the cross-sectional area of the reactor 18. Other phases, such as the liquid phase, present in the reactor 18 are not included in the calculation of the superficial velocity of the vapor phase. It is to be appreciated that the superficial velocity of the vapor phase may be different at various points throughout the reactor 18. As such, the average superficial velocity is the aggregate of the superficial velocities within the reactor 18. The average superficial velocity can be calculated by dividing the length of the reactor 18 by the time it takes the vapor phase to move through the reactor 18.

Although not required, the liquid phase may flow at an average superficial velocity of about 0.001 to about 0.03 feet per second. More specifically, the liquid phase may flow at an average superficial velocity of between about 0.001 to about 0.025 feet per second, of between about 0.001 to about 0.02 feet per second, of between about 0.001 to about 0.016 feet per second, of between about 0.005 to about 0.03 feet per second, of between about 0.005 to about 0.02 feet per second, of between about 0.01 to about 0.03 feet per second, or of between about 0.01 to about 0.02 feet per second.

The superficial velocity of the liquid phase may be calculated by dividing the volumetric flow rate of the liquid phase by the cross-sectional area of the reactor 18. The superficial velocity of the liquid phase is a hypothetical flow velocity calculated as if the liquid phase were the only fluid phase present in the cross-sectional area of the reactor 18. Other phases, such as the vapor phase, present in the reactor 18 are not included in the calculation of the superficial velocity of the liquid phase. It is to be appreciated that the superficial velocity of the liquid phase may be different at various points throughout the reactor 18 due mainly to vapor-liquid equilibria. As such, the average superficial velocity is the aggregate of the superficial velocities within the reactor 18. The average superficial velocity can be calculated by dividing the length of the reactor 18 by the time it takes the liquid phase to move through the reactor 18. It should be noted that the viscosity of the liquid phase may increase as the liquid phase moves through the reactor 18, and thus the liquid phase at an end of the reactor 18 would have a higher liquid depth and be moving at a slower actual velocity. However, neither the total volumetric flow rate nor the superficial velocity of the liquid phase would be affected by changes in viscosity.

A ratio of the vapor phase to the liquid phase may be about 500:1. The vapor phase is largely comprised of the carrier gas 14. It is to be appreciated that, although the hydrocarbon feed 16 may largely be in the liquid phase in the reactor 18, at least a portion of the hydrocarbon feed 16 may vaporize and become part of the vapor phase.

Although not required, the thermal operating conditions in the reactor 18 may include a temperature of between about 400 degrees centigrade and about 480 degrees centigrade. A temperature of between about 400 degrees centigrade and about 480 degrees centigrade is sufficient to induce conversion of the at least one chosen from the hydrocarbon feed and the isotropic pitch to mesophase pitch. More specifically, the thermal operating conditions in the reactor 18 may include a temperature of between about 430 degrees centigrade and about 480 degrees centigrade, of between about 440 degrees centigrade and about 475 degrees centigrade, of about 450 degrees centigrade to about 475 degrees centigrade, of between about 450 degrees centigrade and about 470 degrees centigrade, of between about 450 degrees centigrade and about 465 degrees centigrade. Temperatures below 400 degrees centigrade, or above 480 degrees centigrade, may even be used in the process 10. The particular temperature of the thermal operating conditions in the reactor 18 most suitable for the process 10 is in large part dependent upon the particular composition of the hydrocarbon feed 16. It is to be appreciated, however, that the process 10 is largely able to utilize lower temperatures for each particular composition of the hydrocarbon feed 16 as would otherwise be expected.

It is to be appreciated that a temperature of between about 400 degrees centigrade and about 480 degrees centigrade is relatively low. In the embodiments where the thermal operating conditions in the reactor 18 includes a temperature of between about 400 degrees centigrade and about 480 degrees centigrade, the process 10 achieves several desirable outcomes. Firstly, the temperature of between about 400 degrees centigrade and about 480 degrees centigrade limits formation of coke. Coke is an undesirable and largely commercially worthless impurity which not only contaminates the effluent 24 but also contaminates the processing equipment (e.g., the reactor 18). Coke which contaminates the processing equipment, such as the reactor 18, needs to be periodically removed, thus necessitating shutting down the process 10 to remove the coke and consuming valuable reactor time which may have otherwise been used to run the process 10.

Secondly, the temperature of between about 400 degrees centigrade and about 480 degrees centigrade limits metal leeching (e.g., from the reactor 18) and thus limits metal contamination (i.e., impurities) in the effluent 24. The reactor 18 is typically made of metal, such as stainless steel. High temperatures tend to cause metal to leech from the reactor 18 (e.g., walls of the reactor 18) into the liquid phase and/or the vapor phase within the reactor 18. As such, limiting the temperature of the thermal operating conditions in the reactor 18 to between about 400 degrees centigrade and about 480 degrees centigrade limits the amount of metal impurities in the effluent 24.

Thirdly, the temperature of between about 400 degrees centigrade and about 480 degrees centigrade limits the softening point of the mesophase pitch in the effluent 24. As a non-limiting example, the mesophase pitch may have a softening point of between about 250 degrees centigrade and about 375 degrees centigrade. However, in some of the embodiments where the temperature of the thermal operating conditions of the reactor 18 is between about 400 degrees centigrade and about 480 degrees centigrade, the softening point of the mesophase pitch in the effluent 24 may be between about 300 degrees centigrade and about 315 degrees centigrade, and more specifically between about 305 degrees centigrade and about 310 degrees centigrade. A softening point of the mesophase pitch of between about 300 degrees centigrade and about 315 degrees centigrade, including between about 305 degrees centigrade and about 310 degrees centigrade, is relatively low.

The process 10 may also include the step of preheating at least one chosen from the hydrocarbon feed 16 and the carrier gas 14. In other words, the process 10 may include the step of preheating the hydrocarbon feed 16, may include the step of preheating the carrier gas 14, or may include the step of preheating both the hydrocarbon feed 16 and the carrier gas 14. The step of preheating at least one chosen from the hydrocarbon feed 16 and the carrier gas 14 may be undertaken such that the either, or both, of the hydrocarbon feed 16 and the carrier gas 14 is at the thermal operating conditions of the reactor 18. Although not required, the step of preheating at least one of the hydrocarbon feed 16 and the carrier gas 14 may result in the hydrocarbon feed 16 and/or the carrier gas 14 being at a temperature of between about 400 degrees centigrade and about 480 degrees centigrade. It is also to be appreciated that the step of preheating the hydrocarbon feed 16 and/or the carrier gas 14 may be accomplished before or after mixing, or charging, the hydrocarbon feed 16 and the carrier gas 14. The step of preheating at least one chosen from the hydrocarbon feed 16 and the carrier gas 14 may be accomplished by a heater 48, such as but not limited to a fired heater.

The effluent 24 may include a liquid effluent phase 26. Advantageously, the liquid effluent phase 26 may include at least about 60 percent by volume of mesophase pitch. In other words, the content of the mesophase pitch in the liquid effluent phase 26 is at least about 60 percent by volume. Moreover, the liquid effluent phase may include at least about 65 percent by volume of mesophase pitch, at least about 70 percent by volume of mesophase pitch, at least about 75 percent by volume of mesophase pitch, at least about 80 percent by volume of mesophase pitch, and at least about 85 percent by volume of mesophase pitch. The liquid effluent phase 26 may even include at least about 90 percent by volume of mesophase pitch, at least about 95 percent by volume of mesophase pitch, at least 96 percent by volume of mesophase pitch, at least 97% by volume of mesophase pitch, at least 98% by volume of mesophase pitch, at least 99% by volume of mesophase pitch, or may even consist essentially entirely of mesophase pitch.

The mesophase pitch produced by the process 10 may have a micro carbon residue of between about 89 percent and about 94 percent as measured by ASTM-4530-15. The micro carbon residue is a measure of the carbon content in the mesophase pitch. It is to be appreciated that the micro carbon residue of the mesophase pitch will be higher if more volatiles are removed. The process 10 is able to produce a relatively low softening point mesophase pitch having a relatively high micro carbon residue.

The reactor 18 may be cylindrical, such as a tube or a pipe. The reactor 18 may have a length of between about 20 feet and about 500 feet. Moreover, the reactor 18 may have a length of between about 40 feet and about 400 feet, of between about 50 feet and about 350 feet, of between about 50 feet and about 300 feet, of between about 60 feet and about 280 feet, of between about 70 feet and about 260 feet, of between about 80 feet and about 240 feet, of between about 90 feet and about 220 feet, of between about 100 feet and about 300 feet, or of between about 100 feet and about 300 feet.

Figure 2A:
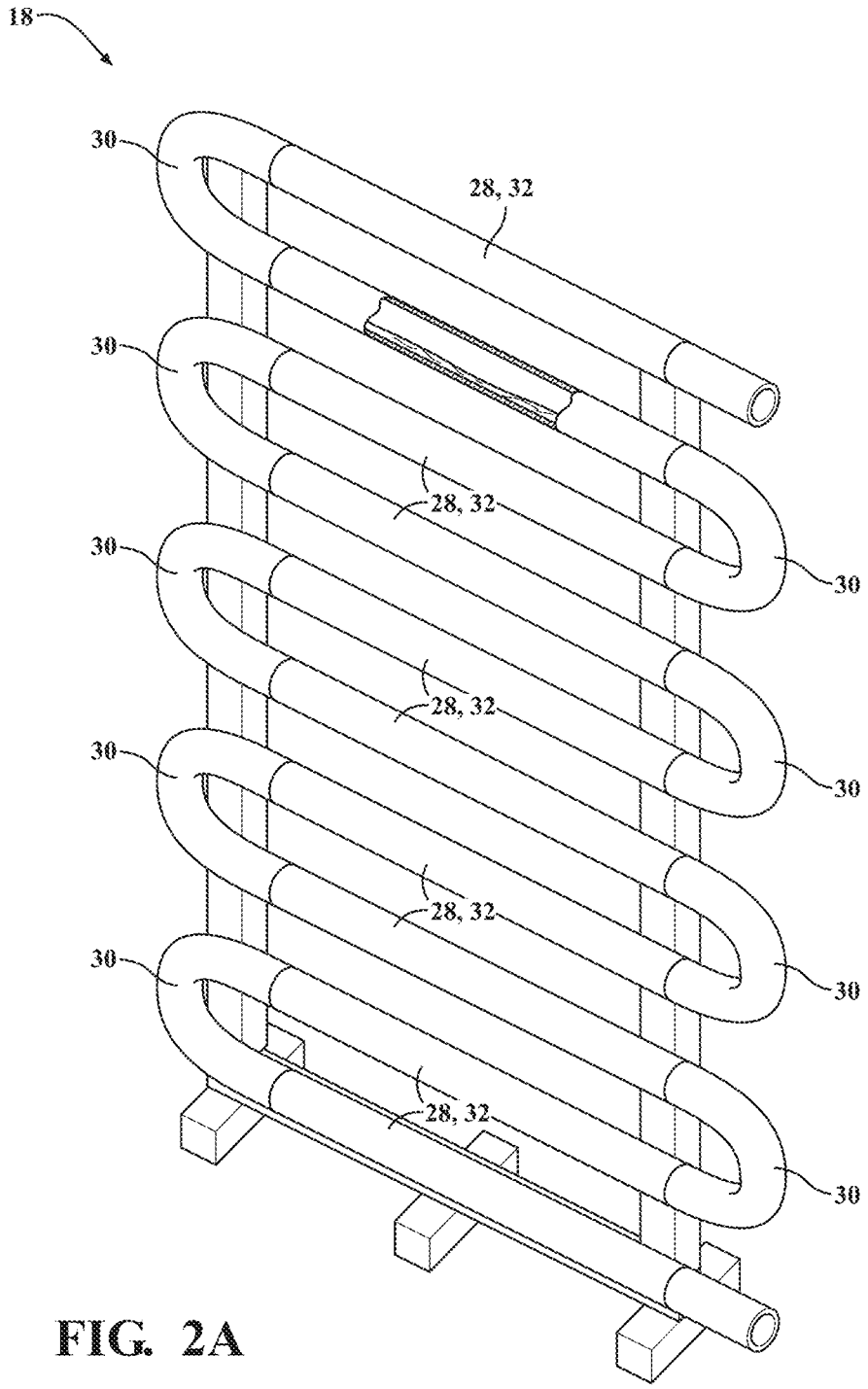
FIG. 2A is a schematic illustration of the reactor including substantially linear segments stacked vertically and arranged to extend approximately horizontally to maintain the stratified flow regime.
Figure 2B:
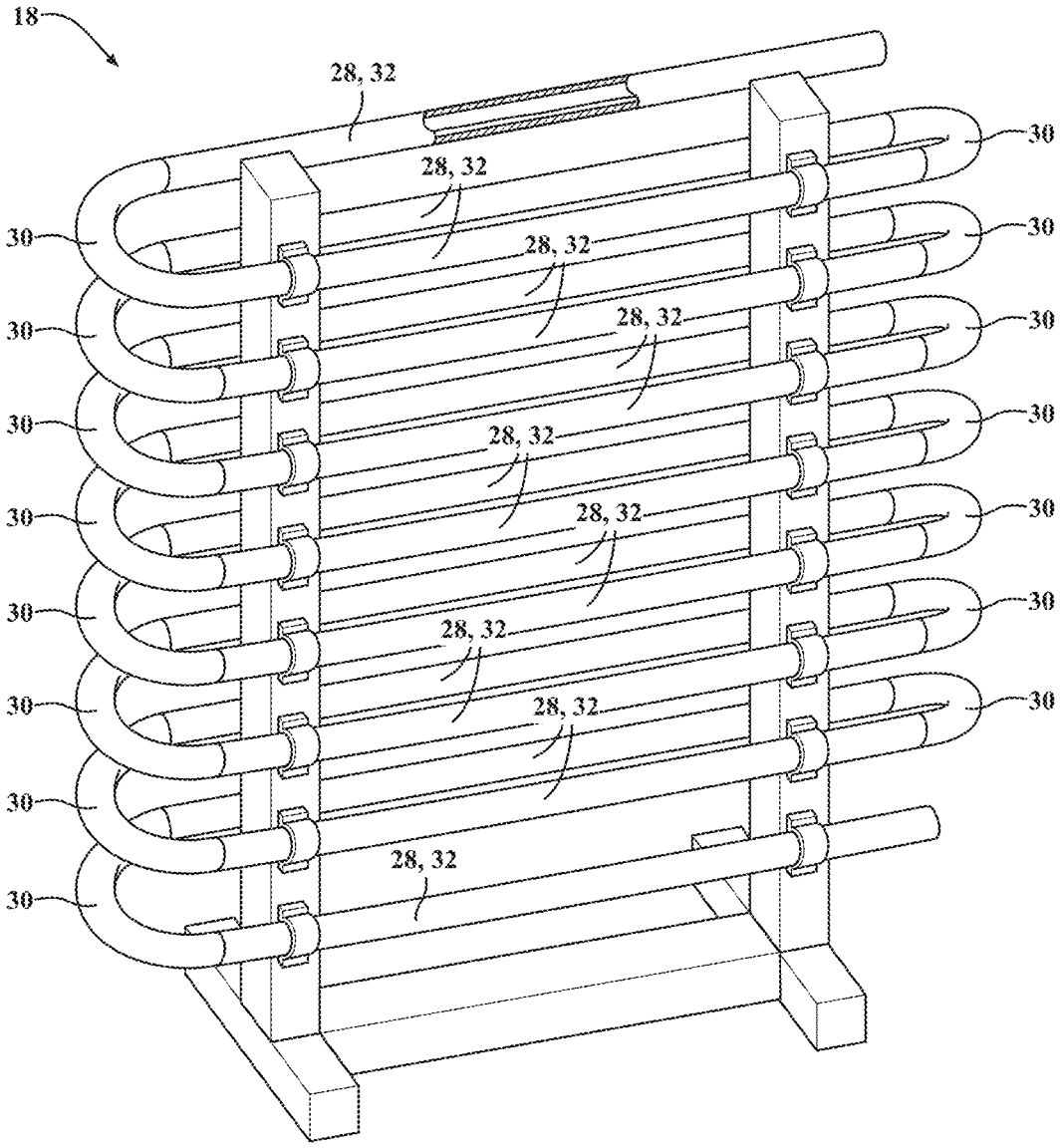
FIG. 2B is a schematic illustration of another embodiment of the reactor including substantially linear segments stacked vertically and arranged to extend approximately horizontally to maintain the stratified flow regime.
Figure 2C:
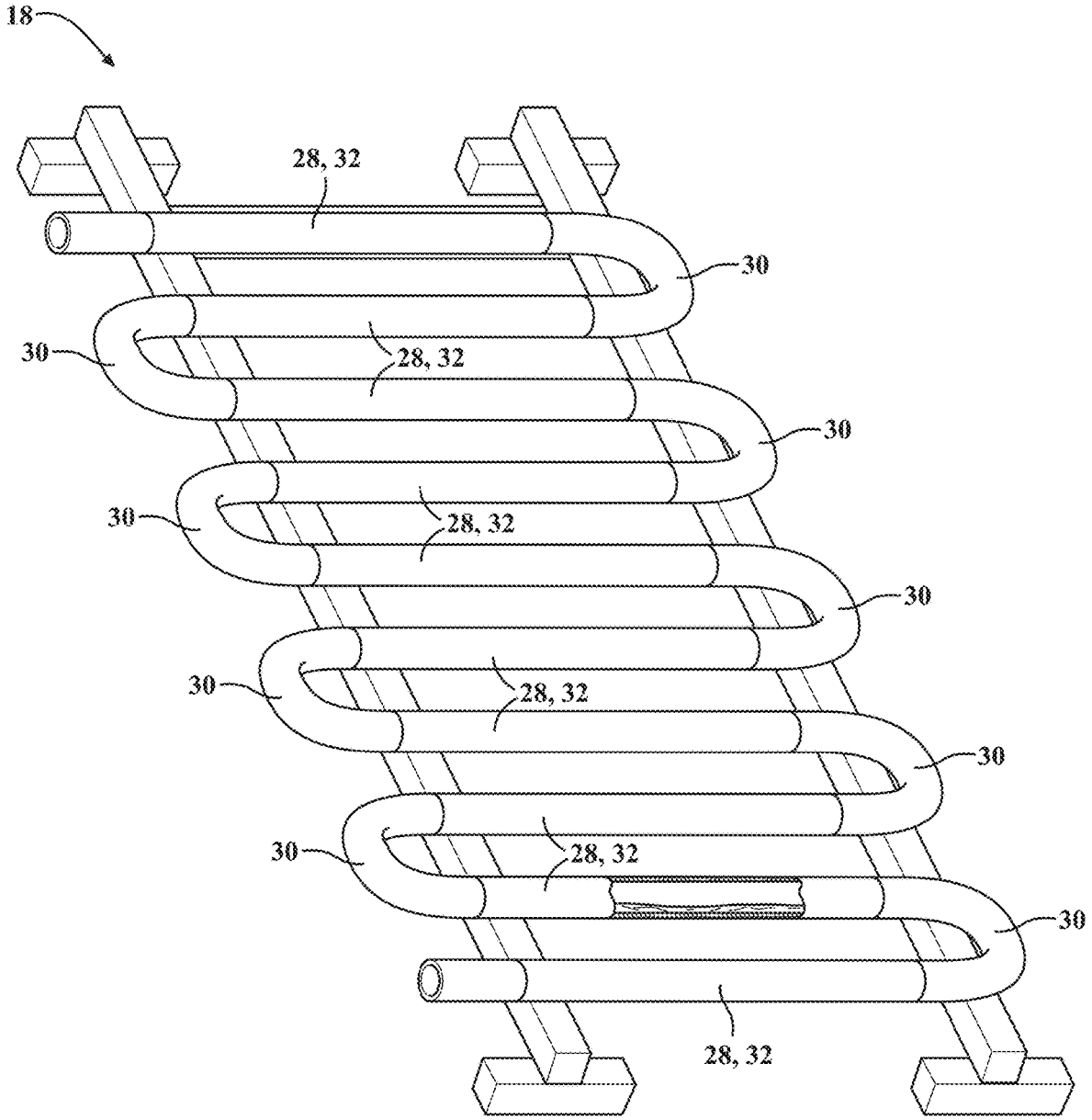
FIG. 2C is a schematic illustration of the reactor including substantially linear segments spaced horizontally and arranged to extend approximately horizontally to maintain the stratified flow regime.
Figure 3:
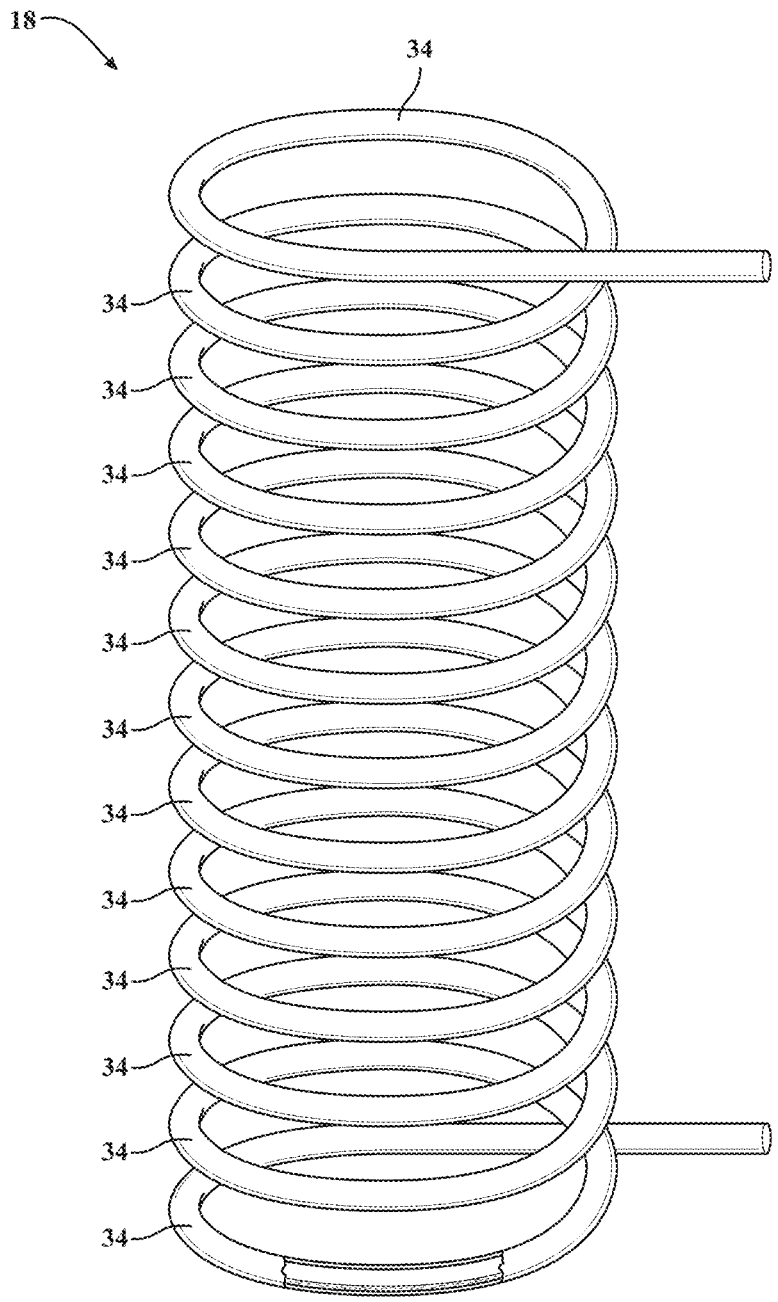
FIG. 3 is a schematic illustration of the reactor including substantially coiled segments stacked vertically and arranged to extend approximately horizontally to maintain the stratified flow regime.
Figure 4:
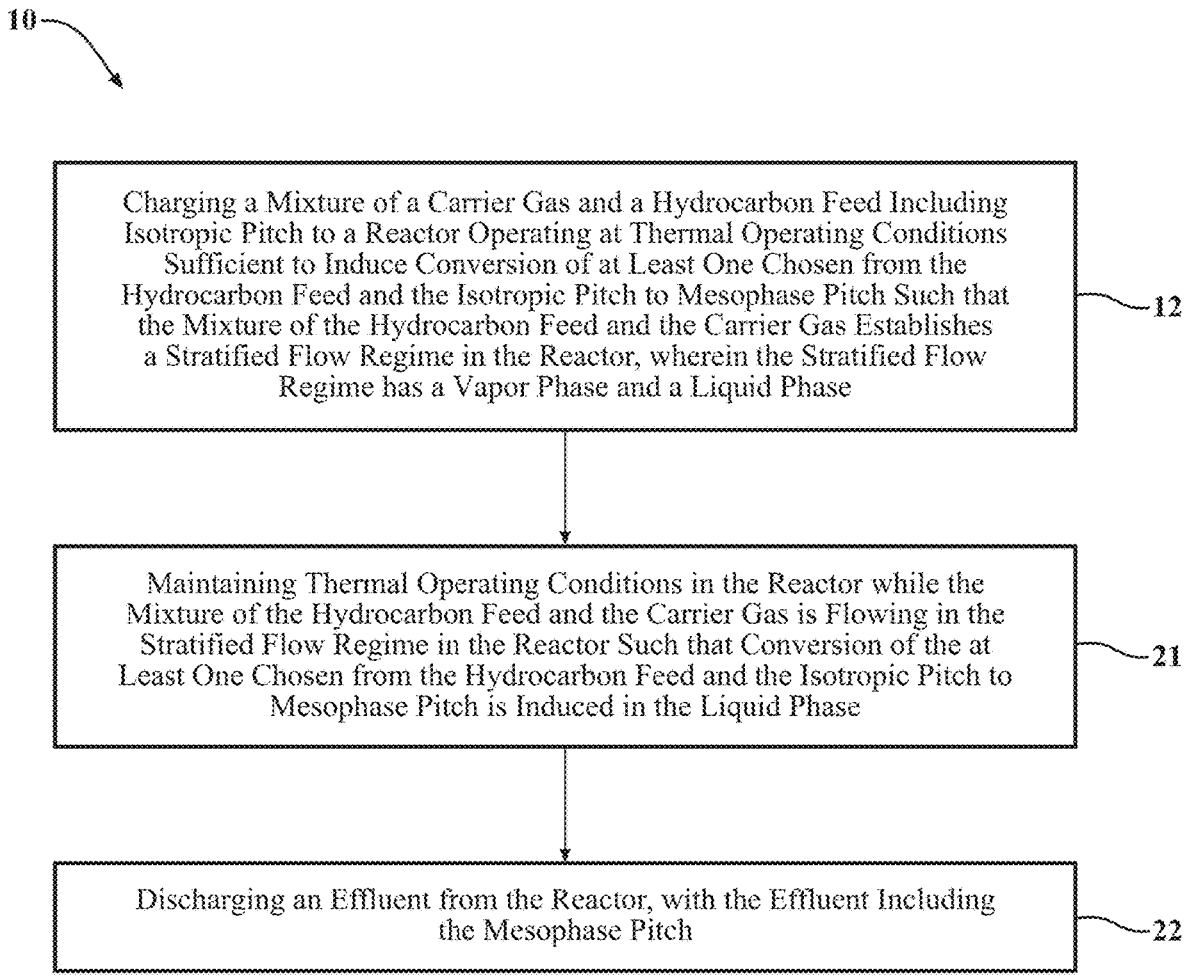
FIG. 4 is a flowchart of the process for producing mesophase pitch.

The reactor 18 may include a plurality of segments 28, each in fluid communication with one another through the use of a plurality of connectors 30. Although not required, the connectors 30 may be approximately U-turns. The connectors 30 may aid in the establishment of the stratified flow regime by coalescing any liquid droplets in the vapor phase with the liquid phase. In one embodiment, as shown in FIGS. 2A through 2C, a majority of the reactor 18 includes one or more substantially linear segments 32 extending along one or more axes. In another embodiment, as shown in FIG. 3, a majority of the reactor 18 includes one or more substantially coiled segments 34 extending about one or more axes. The substantially coiled segments 34 may aid in the establishment of the stratified flow regime by coalescing any liquid droplets in the vapor phase with the liquid phase.

The reactor 18 may be arranged to extend approximately horizontally to maintain the stratified flow regime. In other words, the reactor 18 may be angled between 0 degrees and about 45 degrees relative to flat ground and still be considered to be arranged to extend approximately horizontally. Moreover, the plurality of segments of the reactor 18, including but not limited to the one or more substantially linear segments 32 and/or the one or more substantially coiled segments 34, may be arranged to extend approximately horizontally to maintain the stratified flow regime. The reactor 18 is considered to be arranged to extend approximately horizontally if the plurality of segments of the reactor 18 are arranged to extend approximately horizontally. As such, the connectors may extend vertically and the reactor 18 is still be considered to be arranged to extend approximately horizontally. In a non-limiting example, the segments may be stacked vertically relative to one another and connected with vertically arranged connectors and the reactor 18 is still considered to be arranged to extend approximately horizontally. Vertically stacked segments reduce the footprint of the reactor 18 and save space.

A residence time of the liquid phase in the reactor 18 may be between about 120 seconds and about 2400 seconds. It is also to be appreciated that the residence time of the liquid phase in the reactor 18 may even be less than 120 seconds or more than 2400 seconds. The residence time of the liquid phase in the reactor 18 is dependent in part upon the length of the reactor 18. As a non-limiting example, for a reactor 18 with a length of 140 feet, the residence time of the liquid phase in the reactor 18 may be between about 600 seconds and about 1800 seconds, and more specifically may be between about 1000 seconds and 1600 seconds. As another non-limiting example, for a reactor 18 with a length of 280 feet, the residence time of the liquid phase in the reactor 18 may be between about 1200 seconds and about 2400 seconds, and more specifically may be between about 1600 seconds and 2000 seconds.

The process 10 may also include the step 36 of flowing the effluent 24 discharged from the reactor 18 into a separation vessel 38 and separating a vapor effluent phase 40 and a liquid effluent phase 26 in the separation vessel 38. The process 10 may further include the step 42 of recycling the vapor effluent phase 40 to a condenser 44, the step 46 of condensing a portion of the vapor effluent phase 40 to a liquid recycle feed 50, and the step 52 of flowing a portion of the liquid recycle feed 50 to a polymerization reactor 54 operating under thermal polymerization conditions sufficient to induce thermal polymerization of the liquid recycle feed 50. It is to be understood that the liquid recycle feed 50 includes a liquid phase.

As shown in FIG. 1, the liquid recycle feed 50 exiting the condenser 44 can flow into a second separation vessel 56 that separates a vapor effluent phase 58 from the liquid recycle feed 50 and continues the liquid recycle feed 50 to a pump 60 for transfer to the polymerization reactor 54 and a discharge line 62. The vapor effluent phase 58 is provided to a second condenser 64 for condensing a portion of the vapor effluent phase 58 to a liquid feed 66 that is provided to a third separation vessel 68 that separates the liquid feed 66 to a vapor effluent phase 70 and a liquid effluent phase 72.

A pump 74 can provide the liquid effluent phase 26 from the separation vessel 38 to a third separation vessel 76 that separates a vapor effluent phase 78 from the liquid effluent phase 26.

Although not required, maintaining thermal operating conditions in the reactor 18 may convert between about 20 weight percent and about 95 weight percent of the isotropic pitch in the hydrocarbon feed 16 to mesophase pitch per each pass through the reactor 18. Moreover, maintaining thermal operating conditions in the reactor 18 may convert between about 30 weight percent and about 95 weight percent of the isotropic pitch in the hydrocarbon feed 16 to mesophase pitch per each pass through the reactor 18, may convert between about 40 weight percent and about 95 weight percent of the isotropic pitch in the hydrocarbon feed 16 to mesophase pitch per each pass through the reactor 18, may convert between about 50 weight percent and about 95 weight percent of the isotropic pitch in the hydrocarbon feed 16 to mesophase pitch per each pass through the reactor 18, may convert between about 60 weight percent and about 95 weight percent of the isotropic pitch in the hydrocarbon feed 16 to mesophase pitch per each pass through the reactor 18, or may convert between about 65 weight percent and about 95 weight percent of the isotropic pitch in the hydrocarbon feed 16 to mesophase pitch per each pass through the reactor 18.

The stratified flow regime established in the reactor 18 may be further defined as a stratified-smooth flow regime. Additionally or alternatively, the stratified flow regime established in the reactor 18 may be further defined as a stratified-wavy flow regime. The stratified-wavy flow regime may advantageously increase mixing in the liquid phase and may further facilitate conversion of the hydrocarbon feed 16 and/or isotropic pitch to mesophase pitch. It is to be appreciated that the stratified flow regime established in the reactor 18 may be solely a stratified-smooth flow regime or a stratified-wavy flow regime or may transition between a stratified-smooth flow regime and a stratified-wavy flow regime within the reactor 18. In cases where the superficial velocity of the gas phase becomes too high, the stratified-wavy flow regime will transition into an annular-mist flow regime. When this occurs, liquid in the mist will pass through the reactor in the vapor phase at a much higher velocity than in the annual liquid phase surrounding the interior walls of the reactor. As a result, an annular-mist flow regime is less desirable since it produces a mesophase pitch product that is a mixture of two liquid phases with different residence times and compositions. We also found that when we operated with superficial velocities of the liquid phase that were fairly low, for example less than 0.01 feet/second, we were able to extend the interface between a stratified-wavy flow regime and an annular-mist flow regime to a velocity higher than those reported in the published literature. We believe this is the case because previous air-water flow regime experiments were conducted in which a much higher fraction of the pipes were filled with liquid and it was easier for the liquid to surround the annular interior walls of the pipes.

Moreover, it is further to be appreciated that the stratified flow regime need not be completely laminar. As a non-limiting example, the stratified-wavy flow regime may be either in the transition zone between laminar flow and turbulent flow or may even constitute turbulent flow.

The following examples are intended to illustrate the present disclosure and are not to be read in any way as limiting to the scope of the present disclosure.

Examples 1-5

Examples 1-5 are of processes that are in accordance with the subject disclosure and which can be found in Table 1. Examples 1 and 2 are processes which have been conducted in accordance with the subject disclosure. Examples 3, 4, and 5 are prophetic examples in accordance with the subject disclosure.

Each of Examples 1-5 are of processes 10 which charge a mixture of a carrier gas 14 and a hydrocarbon feed 16 including isotropic pitch to a reactor 18 operating at thermal operating conditions sufficient to induce conversion of at least one chosen from the hydrocarbon feed 16 and the isotropic pitch to mesophase pitch such that the mixture of the hydrocarbon feed 16 and the carrier gas 14 establishes a stratified flow regime in the reactor 18. Each of Examples 1-5 are of processes which maintain the thermal operating conditions in the reactor 18 while the mixture of the hydrocarbon feed 16 and the carrier gas 14 is flowing in the stratified flow regime in the reactor 18 such that conversion of the at least one chosen from the hydrocarbon feed 16 and the isotropic pitch to mesophase pitch is induced in the liquid phase of the stratified flow regime. Each of Examples 1-5 are of processes 10 which further discharge an effluent 24 from the reactor 18, with the effluent 24 including the mesophase pitch.

Examples 1 and 2 are of a process 10 conducted in a reactor 18 having an internal diameter of 0.62 inches. Example 3 is of a process conducted in a reactor 18 having an internal diameter of 3.07 inches, Example 4 is of a process conducted in a reactor 18 having an internal diameter of 5.054.5 inches, and Example 5 is of a process conducted in a reactor 18 having an internal diameter of 8.0 inches. Each of Examples 1-5 are conducted in a reactor 18 having a length of 145 feet. It is to be appreciated that Examples 1-3 are of a single reactor 18, while Examples 4 and 5 are of 3 reactors 18 operating in parallel with one another. Example 3 is of a process estimated to produce about 4.5 thousand tons of mesophase pitch per year, Example 4 is of a process estimated to produce about 12.1 thousand tons of mesophase pitch per year, and Example 5 is of a process estimated to produce about 30.4 thousand tons of mesophase pitch per year.

The thermal operating conditions of each of Examples 1-5 include a temperature of about 450 degrees centigrade and the gauge pressure is about 3.8 psig. The residence time of the liquid phase in the reactor 18 is about 20 minutes for each of Examples 1-5. As can be seen in Table 1, the superficial velocity of the liquid phase is about 0.008 feet per second in Example 1 and about 0.016 feet per second in Examples 2-5.

The carrier gas 14 in each of Examples 1-5 is steam. As can also be seen in Table 1, Example 1 has a carrier gas 14 to hydrocarbon feed 16 ratio of 1, Example 2 has a ratio of 2.0, Example 3 has a ratio of 2.5, Example 4 has a ratio of about 2.86 and Example 5 has a ratio of about 3.33. Approximately 46 percent of the isotropic pitch in the hydrocarbon feed is vaporized in each of Examples 1-5. Referring still to Table 1, the superficial velocity of the vapor phase is about 46.7 feet per second in Example 1, about 49.6 feet per second in Example 2, about 39.7 feet per second in Example 3, about 34.7 in Example 4, and about 29.8 in Example 5.

TABLE 1

| Example | Hydrocarbon Feed Rate (lb/hr) | Carrier Gas Feed Rate (lb/hr) | Liquid Phase Flow Rate (lb/hr) | Vapor Phase Flow Rate (lb/hr) | Liquid Phase Superficial Velocity (Feet/Second) | Vapor Phase Superficial Velocity (Feet/Second) |
|---|---|---|---|---|---|---|
| Example 1 (0.62" ID) | 8.0 | 8.0 | 4.24 | 11.76 | 0.008 | 46.7 |
| Example 2 (0.62" ID) | 17.0 | 8.5 | 9.0 | 16.49 | 0.016 | 49.6 |
| Example 3 (3.07" ID) | 1,250 | 500 | 663 | 1,088 | 0.016 | 39.7 |
| Example 4 (5.05" ID) | 3,384 | 1,184 | 1,793 | 2,774 | 0.016 | 34.7 |
| Example 5 (8.0" ID) | 8,491 | 2,547 | 4,500 | 6,538 | 0.016 | 29.8 |

The invention has been described in an illustrative manner, and it is to be understood that the terminology which has been used is intended to be in the nature of words of description rather than of limitation. Many modifications and variations of the present invention are possible in light of the above teachings, and the invention may be practiced otherwise than as specifically described.

What is claimed is:

1. A process for producing mesophase pitch, said process comprising:

charging a mixture of a carrier gas and a hydrocarbon feed including isotropic pitch to a reactor operating at thermal operating conditions sufficient to induce conversion of at least one chosen from the hydrocarbon feed and the isotropic pitch to mesophase pitch such that the mixture of the hydrocarbon feed and the carrier gas establishes a stratified flow regime in the reactor, wherein the stratified flow regime has a vapor phase and a liquid phase;

maintaining thermal operating conditions in the reactor while the mixture of the hydrocarbon feed and the carrier gas is flowing in the stratified flow regime in the reactor such that conversion of the at least one chosen from the hydrocarbon feed and the isotropic pitch to mesophase pitch is induced in the liquid phase; and discharging an effluent from the reactor, with the effluent including the mesophase pitch.

2. The process as set forth in claim 1, wherein the vapor phase flows at an average superficial velocity of less than about 50 feet per second.

3. The process as set forth in claim 1, wherein the liquid phase flows at an average superficial velocity of about 0.001 to about 0.03 feet per second.

4. The process of claim 1, wherein the thermal operating conditions include a temperature of between about 400 degrees centigrade and about 480 degrees centigrade.

5. The process of claim 1, wherein a residence time of the liquid phase in the reactor is between about 120 seconds and about 2400 seconds.

6. The process of claim 1, wherein the mesophase pitch has a softening point of between about 250 degrees centigrade about 375 degrees centigrade.

7. The process of claim 1, wherein the effluent includes a liquid effluent phase, and wherein the liquid effluent phase includes at least about 60 percent by volume of mesophase pitch.

8. The process of claim 1, wherein the effluent includes a liquid effluent phase, and wherein the liquid effluent phase includes at least about 90 percent by volume of mesophase pitch.

9. The process of claim 1, wherein the effluent includes a liquid effluent phase, and wherein the liquid effluent phase includes at least about 95 percent by volume of mesophase pitch.

10. The process of claim 1, wherein the mesophase pitch has a micro carbon residue of between about 89 percent and about 94 percent as measured by ASTM-4530-15.

11. The process of claim 1, wherein the reactor has a length of between about 20 feet and about 500 feet.

12. The process of claim 1, wherein the reactor has a length of between about 100 feet and about 200 feet.

13. The process of claim 1, wherein a majority of the reactor includes substantially linear segments extending along one or more axes.

14. The process of claim 1, wherein a majority of the reactor includes one or more substantially coiled segments extending about one or more axes.

15. The process of claim 1, wherein the reactor is arranged to extend approximately horizontally to maintain the stratified flow regime.

16. The process of claim 1 further comprising flowing the effluent discharged from the reactor into a separation vessel and separating a vapor effluent phase and a liquid effluent phase in the separation vessel.

17. The process of claim 16 further comprising recycling the vapor effluent phase to a condenser, condensing a portion of the vapor effluent phase to a liquid recycle feed, and flowing a portion of the liquid recycle feed to a polymerization reactor operating under thermal polymerization conditions sufficient to induce thermal polymerization of the liquid recycle feed.

18. The process of claim 1, wherein maintaining thermal operating conditions in the reactor converts between about 20 weight percent and about 95 weight percent of the isotropic pitch in the hydrocarbon feed to the mesophase pitch per each pass through the reactor.

19. The process of claim 1, wherein the stratified flow regime is further defined as a stratified-smooth flow regime.

20. The process of claim 1, wherein the stratified flow regime is further defined as a stratified-wavy flow regime.

* * * * *